US010640241B2

(12) United States Patent
Koike

(10) Patent No.: US 10,640,241 B2
(45) Date of Patent: May 5, 2020

(54) MEDICINE PACKAGING APPARATUS

(71) Applicant: YUYAMA MFG. CO., LTD., Toyonaka-shi, Osaka (JP)

(72) Inventor: Naoki Koike, Toyonaka (JP)

(73) Assignee: YUYAMA MFG. CO., LTD., Toyonaka-Shi, Osaka (JP)

( * ) Notice: Subject to any disclaimer, the term of this patent is extended or adjusted under 35 U.S.C. 154(b) by 141 days.

(21) Appl. No.: 15/561,505

(22) PCT Filed: Mar. 16, 2016

(86) PCT No.: PCT/JP2016/058345
§ 371 (c)(1),
(2) Date: Sep. 25, 2017

(87) PCT Pub. No.: WO2016/158422
PCT Pub. Date: Oct. 6, 2016

(65) Prior Publication Data

US 2018/0065765 A1 Mar. 8, 2018

(30) Foreign Application Priority Data

Mar. 27, 2015 (JP) ..... 2015-065719

(51) Int. Cl.
*B65B 5/00* (2006.01)
*B65B 5/10* (2006.01)
(Continued)

(52) U.S. Cl.
CPC ..... *B65B 5/103* (2013.01); *A61J 3/00* (2013.01); *B65B 1/30* (2013.01); *B65B 9/073* (2013.01);
(Continued)

(58) Field of Classification Search
CPC ..... B65B 5/103; B65B 5/10; B65B 57/20; B65B 35/08
(Continued)

(56) References Cited

U.S. PATENT DOCUMENTS 5,875,610 A * 3/1999 Yuyama ..... B29C 66/1122 53/75
2002/0096535 A1* 7/2002 Zhang ..... B65B 35/08 221/258
2011/0126489 A1* 6/2011 Kodama ..... B29C 65/18 53/374.4

FOREIGN PATENT DOCUMENTS

JP S63-294307 A 12/1988
JP 2007/191197 A 8/2007
(Continued)

OTHER PUBLICATIONS

JPO, Office Action issued in corresponding Japanese Patent Application No. 2016-545366, dated Jul. 5, 2017, total 5 pages with English translation.
(Continued)

*Primary Examiner* — Chelsea E Stinson
(74) *Attorney, Agent, or Firm* — Masuvalley & Partners

(57) ABSTRACT

A medicine packaging apparatus 10 has a packaging paper supplying part 42; a sealing device 50 for forming a packaging bag; a medicine introducing part 80 for introducing the medicines M from an opening portion of the packaging bag P in an unsealed-state; a detecting part 90 for detecting presence of the medicines M in an introducing path for the medicines M by the medicine introducing part 80 and a determining part which can determine that a packaging failure occurs under a condition that the presence of the medicines M is detected by the detecting part 90 within a time period after a timing of starting to seal the packaging bag P in which the medicines M have been introduced and
(Continued)

before a timing of introducing the medicines M to be packaged in a subsequent packaging bag P through the medicine introducing part 80.

7 Claims, 11 Drawing Sheets

(51) Int. Cl.

| | |
|---|---|
| ***A61J 3/00*** | (2006.01) |
| ***B65B 57/10*** | (2006.01) |
| ***B65B 51/28*** | (2006.01) |
| ***B65B 57/18*** | (2006.01) |
| ***B65B 9/073*** | (2012.01) |
| ***B65B 1/30*** | (2006.01) |
| ***B65B 9/087*** | (2012.01) |
| ***B65B 51/10*** | (2006.01) |
| *B65B 59/00* | (2006.01) |
| *A61J 7/00* | (2006.01) |

(52) U.S. Cl.
CPC ..... *B65B 9/087* (2013.01); *B65B 51/10* (2013.01); *B65B 51/28* (2013.01); *B65B 57/10* (2013.01); *B65B 57/18* (2013.01); *A61J 7/0084* (2013.01); *B65B 59/00* (2013.01)

(58) Field of Classification Search
USPC ..... 53/53, 475, 244, 52, 54
See application file for complete search history.

(56) References Cited

FOREIGN PATENT DOCUMENTS

| | | | |
|---|---|---|---|
| JP | 2013-241220 | A | 12/2013 |
| JP | 2014-188101 | A | 10/2014 |
| JP | 2015-066227 | A | 4/2015 |
| WO | 97/02179 | A1 | 1/1997 |
| WO | 00/714220 | A1 | 11/2000 |
| WO | 2009/054440 | A1 | 4/2009 |
| WO | 2010/010863 | A2 | 1/2010 |
| WO | 2013/108202 | A1 | 7/2013 |

OTHER PUBLICATIONS

ISA/JPO, International Search Report issued in PCT/JP2016/058345, dated Apr. 12, 2016, total 4 pages with English translation.
EPO, The Extended European Search Report dated Feb. 8, 2018 in European Patent Application No. 16772305.5, 9 pages.

* cited by examiner

MEDICINE PACKAGING APPARATUS

RELATED APPLICATIONS

This application is a national phase application under 35 U.S.C. § 371 of International Patent Application No. PCT/JP2016/058345, filed on Mar. 16, 2016, which claims priority under 35 U.S.C. § 119 to Japanese Patent Application No. 2015-065719, filed on Mar. 27, 2015, which are hereby expressly incorporated by reference in their entirety for all purposes.

TECHNICAL FIELD

The present invention relates to a medicine packaging apparatus.

BACKGROUND ART

Conventionally, there is provided a medicine packaging apparatus as disclosed in the following patent document 1: JP 2010-010863A. According to this medicine packaging apparatus, it is possible to individually package medicines, which are dispensed from a medicine supplying part in accordance with a prescription, in units of one dose with a packaging paper for medicine packaging. Specifically, in this medicine packaging apparatus, the medicines supplied from the medicine supplying part are first introduced into the packaging paper in an unsealed-state which is formed by a sealing device provided at a medicine packaging part. Then, an opening portion of the packaging paper is sealed by the sealing device to package the medicines in units of one dose.

SUMMARY OF THE INVENTION

Here, in the case of packaging medicines by using the described conventional medicine packaging apparatus, there is concern that some of the medicines overflow from a packaging bag when the amount of medicines supplied from the medicine supplying part are too many for the size of the packaging bag or when the opening portion of the packaging bag is sealed by the sealing device. If the medicines overflow from the package bag in which the medicines should be packaged, this causes concern that the overflowing medicines are mistakenly packaged in a packaging bag subsequently formed and concern that the overflowing medicines get into a portion of the opening portion of the package bag to be sealed by the sealing device. However, there is a problem that the conventional medicine packaging apparatus is not configured to confirm whether or not the medicines are reliably packaged and it cannot be avoided to enhance inspection performed by a pharmacist or the like after the packaging operation.

Thus, the present invention is intended to provide a medicine packaging apparatus which can confirm whether or not medicines supplied to be packaged are reliably packaged.

The medicine packaging apparatus according to the present invention provided for solving the above problem comprises a packaging paper supplying part for supplying a packaging paper for packaging medicines; a sealing part for forming a packaging bag from the packaging paper supplied from the packaging paper supplying part; a medicine introducing part for introducing the medicines into the packaging paper on an upper stream side of a carrying direction of the packaging paper than the sealing part, a detecting part for detecting presence of the medicines which are inside the packaging paper and on the upper stream side of the carrying direction than the sealing part; and a determining part for determining a packaging condition, wherein the medicine packaging apparatus uses the detecting part to perform a sealing detection for detecting the presence of the medicines within a time period after a timing of starting to seal the packaging bag in which the medicines have been introduced and before a timing of introducing the medicines to be packaged into a subsequent packaging bag through the medicine introducing part, and wherein an event that the presence of the medicines is not detected in the sealing detection is set as a determination condition for determining that the medicines are normally packaged.

In the medicine packaging apparatus according to the present invention, by providing the detecting part, it is enabled to detect the presence of the medicines in an area on the upper stream side of the carrying direction of the packaging paper than the sealing part. Further, in the medicine packaging apparatus according to the present invention, by providing the detecting part, it is possible to determine whether or not the medicines are normally packaged without overflowing from the packaging bag in which the medicines should be packaged based on a detecting result of the detecting part.

Namely, in the case where the presence of the medicines is not detected by the detecting part within the time period after the timing of starting to seal the packaging bag in which the medicines have been introduced and before the timing of introducing the medicines to be packaged into the subsequent packaging bag through the medicine introducing part, there is a high possibility that the medicines are normally packaged without overflowing from the packaging bag in which the medicines should be packaged. Based on this knowledge, in the present invention, the determination that the medicines are normally packaged is performed with using the event that the presence of the medicines is not detected by the detecting part within the described time period as the determination condition. Thus, according to the medicine packaging apparatus of the present invention, it is possible to accurately detect whether or not the medicines are reliably packaged in the packaging bag in which the medicines should be packaged.

Further, the medicine packaging apparatus of the present invention provided based on the same knowledge comprises a packaging paper supplying part for supplying a packaging paper for packaging medicines; a sealing part for forming a packaging bag from the packaging paper supplied from the packaging paper supplying part; a medicine introducing part for introducing the medicines into the packaging paper on an upper stream side of a carrying direction of the packaging paper than the sealing part, a detecting part for detecting presence of the medicines which are inside the packaging paper and on the upper stream side of the carrying direction than the sealing part; and a determining part for determining a packaging condition, wherein the medicine packaging apparatus uses the detecting part to perform a sealing detection for detecting the presence of the medicines within a time period after a timing of starting to seal the packaging bag in which the medicines have been introduced and before a timing of introducing the medicines to be packaged into a subsequent packaging bag through the medicine introducing part, and wherein an event that the presence of the medicines is detected in the sealing detection is set as a determination condition for determining that a packaging failure occurs.

The medicine packaging apparatus of the present invention can detect the presence of the medicines in an area on the upper stream side of the carrying direction of the packaging paper than the sealing part by using the detecting part and determine whether or not the medicines overflow from the packaging bag in which the medicines should be packaged based on a result of the sealing detection performed by the detecting part. Namely, in the case where the presence of the medicines is detected by the detecting part within the time period after the timing of starting to seal the packaging bag in which the medicines have been introduced and before the timing of introducing the medicines to be packaged into the subsequent packaging bag, there is a high possibility that the medicines overflowing from the packaging bag in which the medicines should be packaged are detected. Based on this knowledge, in the present invention, the event that the presence of the medicines is detected by the detecting part within the described time period is set as a determination condition to determine the presence or absence of a packaging failure. Thus, according to the medicine packaging apparatus of the present invention, it is possible to accurately detect the presence or absence of the packaging failure.

Here, in order to more improve the determination accuracy for determining whether or not the medicines to be packaged are reliably packaged, it is preferable to make it possible to not only determine the sealing condition of the packaging bag as described above but also determine that the medicines are introduced into the packaging paper by the medicine introducing part.

Based on this knowledge, it is preferred that the described medicine packaging apparatus according to the present invention uses the detecting part to perform an introducing detection for detecting introduction of the medicines into the packaging paper by the medicine introducing part and an event that the introduction of the medicines is detected in the introducing detection is set as a determination condition for determining that the medicines are normally packaged.

With this configuration, it becomes also possible to determine that the medicines are introduced into the packaging paper by the medicine introducing part, and thereby even more improving the determination accuracy for determining that the medicines to be packaged are reliably packaged.

In the described medicine packaging apparatus according to the present invention, it may be possible that bonding of the packaging paper by the sealing part is interrupted within a time period after the timing of starting to seal the packaging bag in which the medicines have been introduced and before the sealing completes and detection of the medicines by the detecting part is performed within a time period in which the bonding of the packaging paper has been interrupted.

By detecting the medicines with the detecting part within the time period in which the bonding of the packaging paper has been interrupted as the present invention, it is possible to even more improve the determination accuracy. Further, by interrupting the bonding of the packaging paper within the time period after starting to seal the packaging paper and before the sealing completes, it is possible to take steps for addressing the packaging failure until the bonding of the packaging paper completes even if the medicines overflow from the packaging bag in which the medicines should be packaged. Specifically, it is possible to take steps of interrupting the bonding of the packaging paper in order to prevent the overflowing medicines from getting into a bonding portion of the packaging paper which is about to be formed and the like, for example.

In the described medicine packaging apparatus according to the present invention, it may be possible that the sealing part includes a horizontally sealing member which can seal the packaging paper which is in an overlapped state in a lengthwise direction of the packaging paper and a vertically sealing member which can seal the packaging paper in a short direction of the packaging paper, wherein detection of the medicines by the detecting part is performed within a time period after sealing the packaging paper in the short direction of the packaging paper between a previous packaging bag and a subsequent packaging bag which continue in the lengthwise direction of the packaging paper by using the vertically sealing member and before the medicines to be packaged into the subsequent packaging bag are introduced.

With this configuration, it is possible to provide the medicine packaging apparatus which can accurately confirm whether or not the medicines supplied to be packaged are reliably packaged.

In the described medicine packaging apparatus according to the present invention, it is preferred that bonding of the packaging paper is interrupted and the detection by the detecting part is performed at a timing when the vertically sealing member contacts with the packaging paper to form a vertical seal between the previous packaging bag and the subsequent packaging bag.

With this configuration, it is possible to accurately detect the occurrence of the packaging failure with preventing the overflowing medicines from being caught by the vertically sealing member just in case where the medicines overflow from the packaging bag in which the medicines should be packaged.

In the described medicine packaging apparatus according to the present invention, it is preferred that the detecting part includes a camera which can photograph an inside of the packaging paper on the upper stream side of the carrying direction of the packaging paper than the sealing part.

With this configuration, it is possible to accurately detect the presence of the medicines based on an image obtained from the camera.

In the described medicine packaging apparatus according to the present invention, it is preferred that at least a tip end portion of the medicine introducing part is inserted into the packaging bag which is in an unsealed-state and the detecting part is arranged so as to be directed from a base-end side to a tip-end side of the medicine introducing part.

With this configuration, it is possible to even more accurately detect whether or not the medicines overflow from the packaging bag in which the medicines should be packaged.

According to the present invention, it is possible to provide the medicine packaging apparatus which can confirm whether or not the medicines supplied to be packaged are reliably packaged.

DETAILED DESCRIPTION OF THE INVENTION

Hereinafter, a medicine packaging apparatus 10 according to one embodiment of the present invention will be described in detail with reference to the accompanying drawings. In this regard, in the following description, a configuration of the medicine packaging apparatus 10 is first described and then a determining method for a packaging failure performed in the medicine packaging apparatus 10 is described.

<<About the Configuration of the Medicine Packaging Apparatus 10>>

Figure 1:
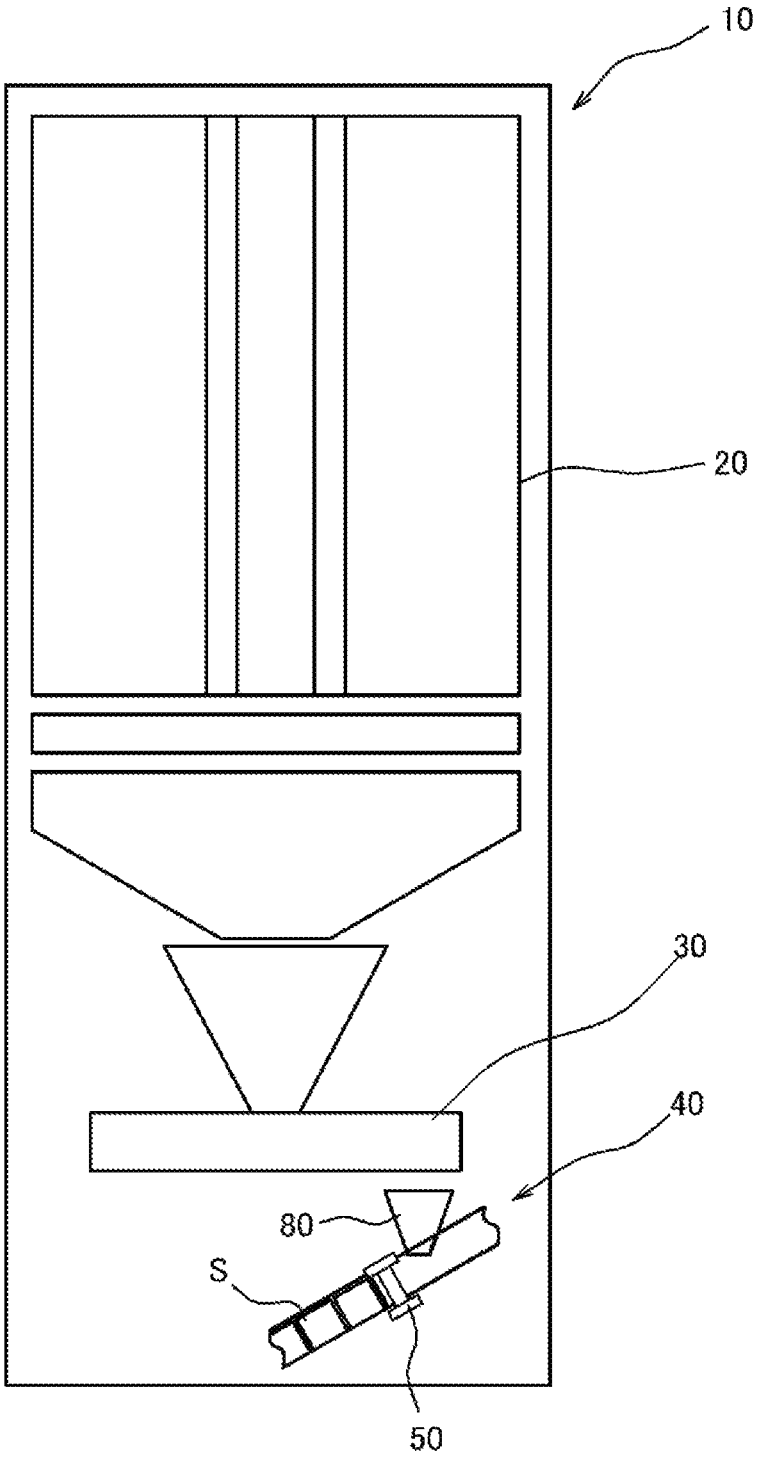
FIG. 1 is a conceptual view schematically showing an internal structure of a medicine packaging apparatus according to one embodiment of the present invention.

As shown in FIG. 1, the medicine packaging apparatus 10 has a medicine supplying part 20, a medicine preparing part 30 and a medicine packing part 40. In addition to these components, the medicine packaging apparatus 10 includes a medicine introducing part 80, a detecting part 90 and a control device 100.

The medicine supplying part 20 has functions of storing medicines M and dispensing the medicines M to the medicine preparing part 30 in accordance with a prescription. Further, the medicine preparing part 30 has a function of storing the medicines M in units of one package to dispense the medicines M to the medicine packing part 40 in units of one package.

Figure 2:
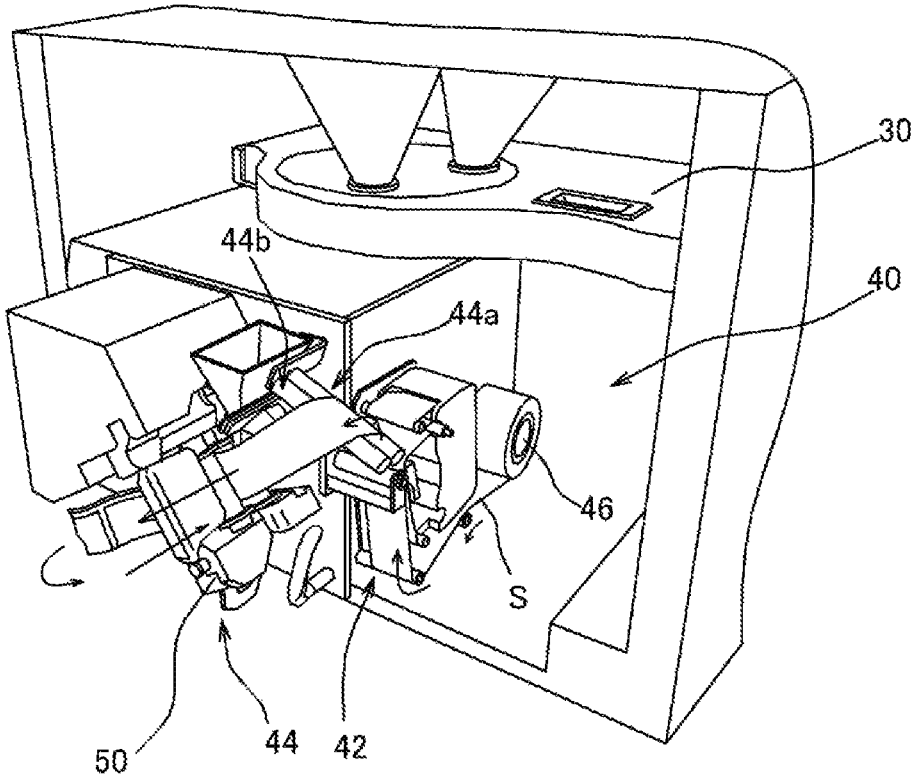
FIG. 2 is a perspective view showing a configuration in the vicinity of a medicine preparing part and a medicine packaging part of the medicine packaging apparatus shown in FIG. 1.

The medicine packing part 40 is configured to package the medicines M dispensed from the medicine preparing part 30 in units of one package and is provided below the medicine preparing part 30 as shown in FIG. 2. The medicine packing part 40 has a packaging paper supplying part 42 and a packing mechanism 44. The packaging paper supplying part 42 is a mechanism for unreeling a packaging paper S rolled around a roll axis 46 to supply the packaging paper S to the side of the packing mechanism 44. The packaging paper S is a thermal bonding sheet having an elongated sheet-like shape and rolled around the roll axis 46 in a state that the packaging paper S is two-folded in the short direction thereof. The packing mechanism 44 has a sheet supporting portion 44*a*, a guiding member 44*b* and a sealing device 50 (sealing part). The packing mechanism 44 can package the medicines M supplied from the side of the medicine supplying part 20 by press-bonding the packaging paper S supplied from the packaging paper supplying part 42 to form the packaging paper S into a bag shape.

Figure 5:
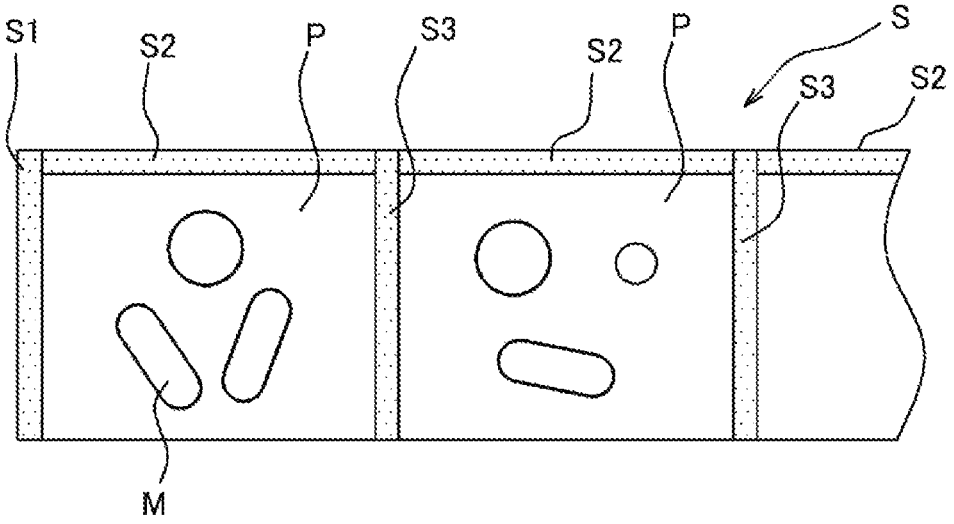
FIG. 5 is an explanation view showing a state that medicines are packaged.

More specifically, the guiding member 44*b* has a function as a guide for guiding the packaging paper S supplied from the packaging paper supplying part 42. The sealing device 50 can press-bond a portion of the packaging paper S on the one end side of the lengthwise direction of the packaging paper S (the downstream side) supplied with being guided by the guiding member 44*b* or the like to form the packaging paper S into a half-bag shape and press-bond and close an opening portion of the packaging paper S formed in the half-bag shape to form the packaging paper S into the bag shape. Even more specifically, by press-bonding the packaging paper S with the sealing device 50, it is possible to form a packaging bag P containing the medicines M as shown in FIG. 5. The sealing device 50 forms a vertical seal (a first vertical seal S1 or a second vertical seal S3) closing a portion of the packaging paper S on a downstream side of a travelling direction of the packaging paper S in a short direction thereof and forms a horizontal seal S2 of the packaging bag P being about to be formed. With this operation, the half-bag shaped packaging paper S (the packaging bag P) having the opening portion at a portion on an upper stream side of the travelling direction of the packaging paper S is formed. The medicines M are introduced into the half-bag shaped packaging paper S (the packaging bag P) in this state and then the opening portion is closed by the sealing device 50. Namely, in the case where a part of the horizontal seal S2 is unsealed, this unsealed portion is closed and the vertical seal (the second vertical seal S3) closing the packaging paper S in the short direction thereof on the upper stream side of the travelling direction of the packaging paper S is formed by the sealing device 50 to seal the packaging paper S.

Figure 3:
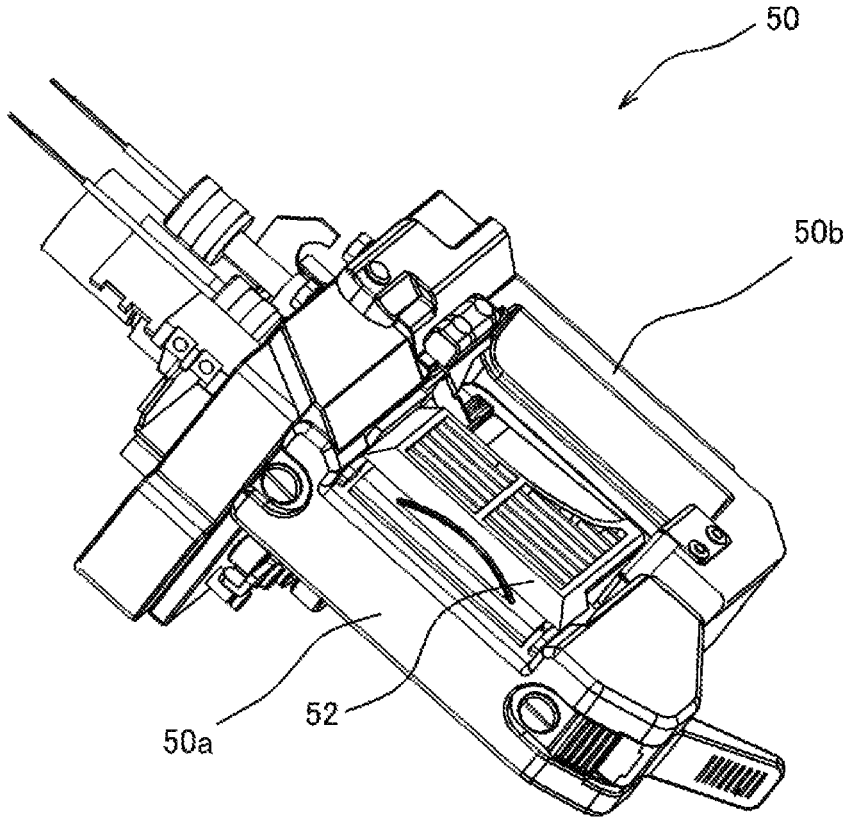
FIG. 3 is a perspective view of a sealing device.

As shown in FIG. 3 and FIG. 4, a main part of the sealing device 50 is constituted of a pair of roller frames 50*a*, 50*b*. As shown in FIG. 3, although a protect cover 52 is provided on the side of the roller frame 50*a* in the sealing device 50, the roller frames 50*a*, 50*b* are substantially symmetrical in a state that the roller frames 50*a*, 50*b* face each other as shown in FIG. 4 in a state that the protect cover 52 is removed.

As shown in FIG. 4 or the like, each of the roller frames 50*a*, 50*b* is constituted of a metallic frame having a substantial U-shape in a front view thereof. Supporting axes 54 extending in the vertical direction are provided on the roller frames 50*a*, 50*b* and vertically sealing members 56 and horizontally sealing members 58 are attached to the supporting axes 54. Each of the vertically sealing members 56 and the horizontally sealing members 58 is rotatably attached to the supporting axes 54. Further, since the vertically sealing members 56 and the horizontally sealing members 58 are respectively connected to different power sources (not shown in the drawings) through different power transmission mechanisms (not shown in the drawings) to allow the vertically sealing members 56 and the horizontally sealing members 58 to rotate independently to each other, it is possible to change a bag-length by changing rotational speeds of the vertically sealing members 56 and the horizontally sealing members 58.

Figure 4A:
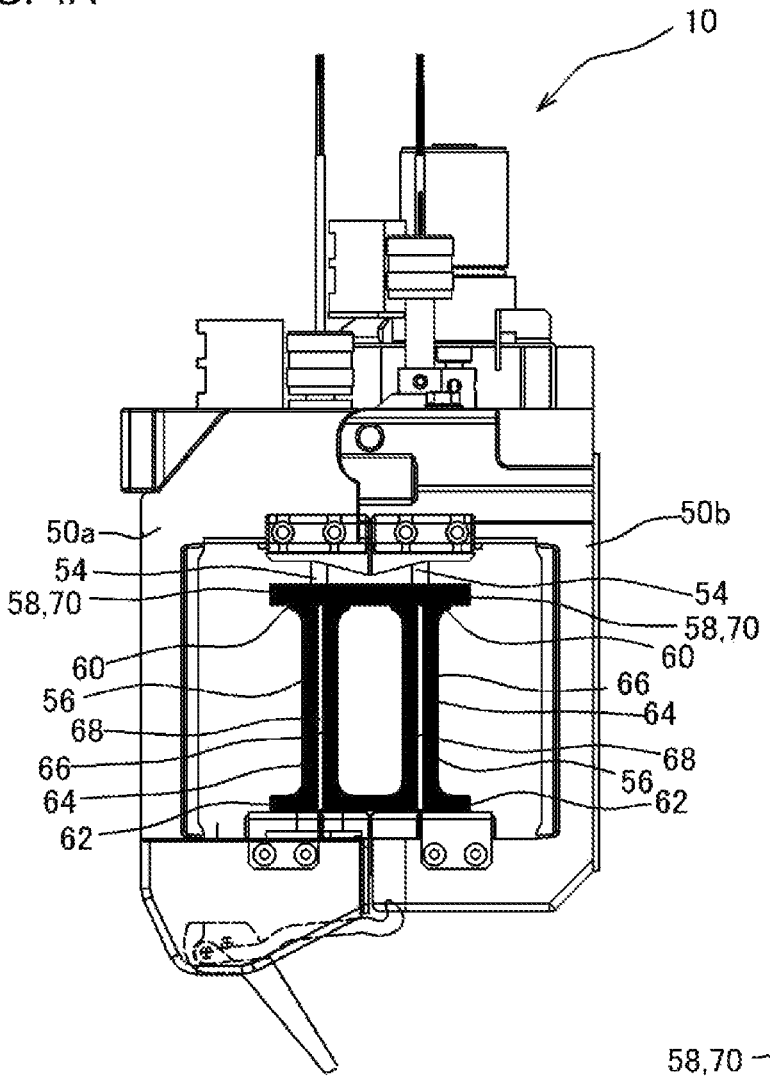
FIG. 4A is a front view showing the sealing device in a state that a protect cover is removed and FIG. 4B is a perspective view showing a vertical heating body.
Figure 4B:
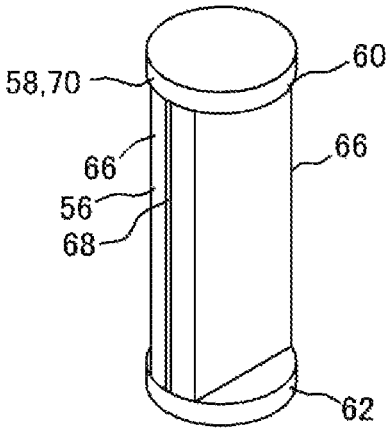

Each of the vertically sealing members 56 is made of a metallic material and formed into a substantially liner shape in a front view thereof as shown in FIG. 4A. Each of the vertically sealing members 56 has a lower end portion 62 having a discoid shape and a heating portion 64 having a plate shape as shown in FIG. 4B. Each heating portion 64 is positioned between an upper end portion 60 constituting the horizontally sealing member 58 described later and the lower end portion 62 so as to be substantially perpendicular to the upper end portion 60 and the lower end portion 62. Heaters 66 and cutoff line forming portions 68 are linearly arranged on both side surfaces of the heating portion 64 from the side of the upper end portion 60 toward the lower end portion 62. The heaters 66, 66 can thermal-bond the packaging paper S. Thus, by rotating the vertically sealing members 56, 56 arranged in parallel with each other and passing the two-folded packaging paper S between the vertically sealing members 56, 56, it is possible to form a seal (the vertical seal) extending in the short direction of the packaging paper S.

Further, the cutoff line forming portions 68 can form a perforation on the packaging paper S. In this embodiment, the cutoff line forming portion 68 on the side of the roller frame 50*b* is constituted of a cutter for forming the perforation and the cutoff line forming portion 68 on the side of the roller frame 50*a* is constituted of a receiving blade provided so as to correspond to the cutter.

As shown in FIG. 4A, each of the horizontally sealing members 58 has the described upper end portion 60 and a heater 70. The upper end portion is a discoid member provided on the upper side of the heating portion 64 of the vertically sealing member 56. The heater 70 is provided on a circumference of the upper end portion 60 so as to cover the whole of the circumference of the upper end portion 60. Thus, by rotating the horizontally sealing members 58, 58 arranged in parallel with each other and passing the two-folded packaging paper S between the upper end portions 60, 60, it is possible to form a seal (the horizontal seal) extending in the lengthwise direction of the packaging paper S.

As shown in FIG. 4, the sealing device 50 is configured to arrange the vertically sealing members 56, and the horizontally sealing members 58, 58 in substantially parallel with each other through predetermined clearances in a substantially square-shaped area surrounded by the roller frames 50*a*, 50*b*. The sealing device 50 can rotate the vertically sealing members 56, 56 and the horizontally sealing members 58, and pass the packaging paper S through the clearances among these members to form the horizontal seal and the vertical seal, and thereby forming the packaging bag P.

Figure 6:
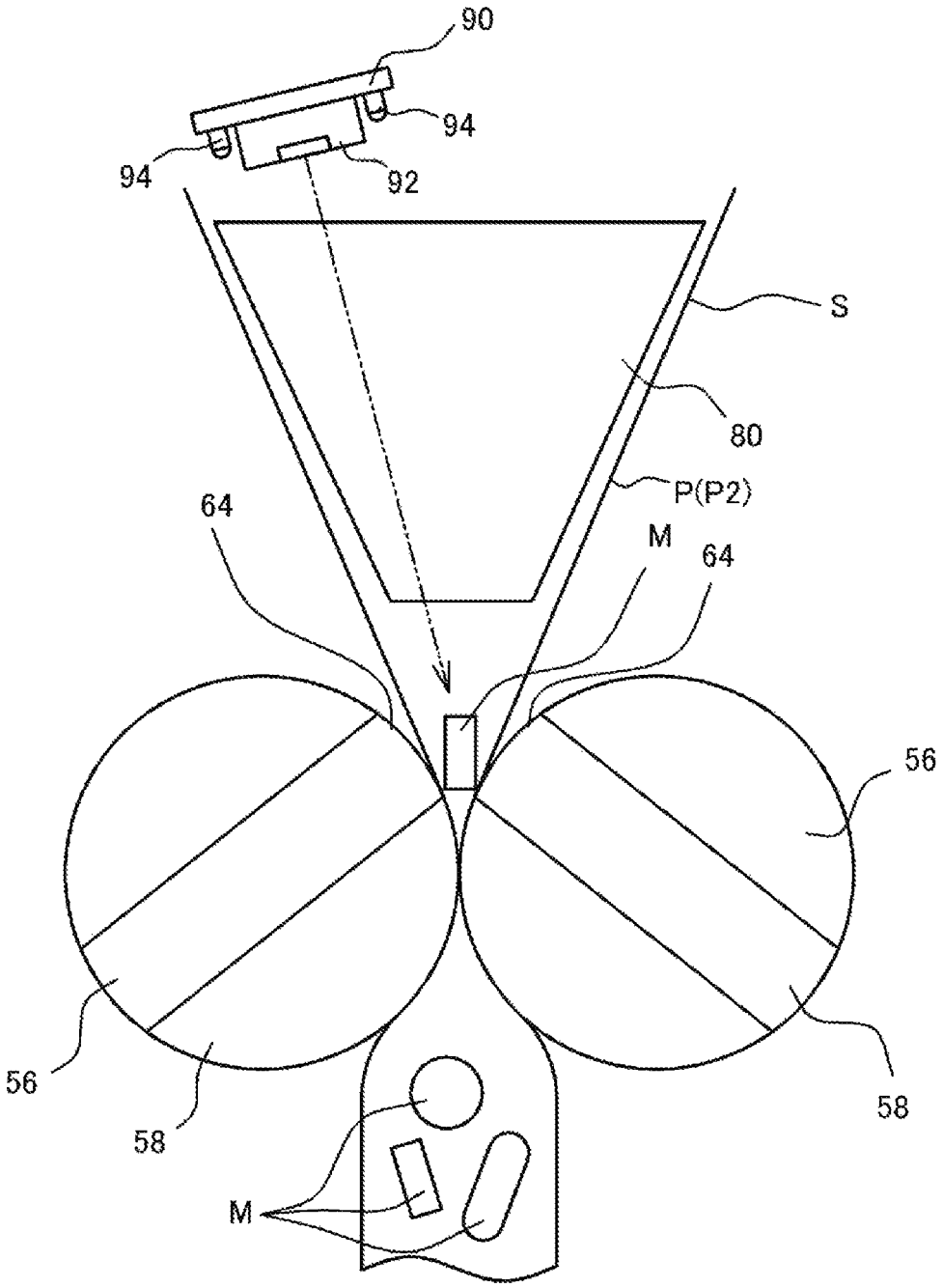
FIG. 6 is a planar view showing a hopper and a vertically sealing member and a horizontally sealing member which constitute the sealing device with a simplified manner in order to explain a detecting status for a packaging condition performed in the medicine packaging apparatus shown in FIG. 1.
Figure 7:
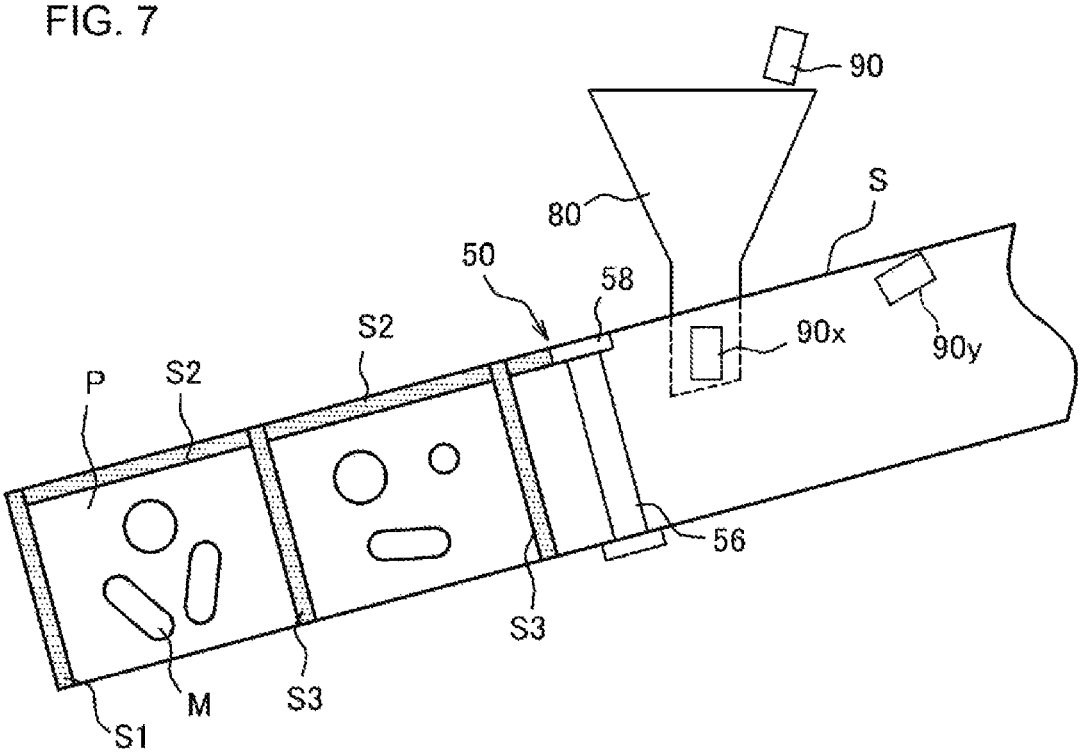
FIG. 7 is a schematic view showing an arrangement of a sealing part, the hopper and a detecting part in the medicine packaging apparatus shown in FIG. 1.

The medicine introducing part 80 is used for supplying the medicines M dispensed from the medicine preparing part 30 in units of one package to the medicine packing part 40. Although the medicine introducing part 80 may be any part as long as it can supply the medicines M into the packaging paper S, the medicine introducing part 80 is constituted of a hopper in this embodiment. As shown in FIG. 1, FIG. 6 and FIG. 7, the medicine introducing part 80 is enabled to be inserted into the opening portion of the packaging bag P in the unsealed-state which is formed by the sealing device 50 to introduce the medicines M into the packaging bag P. Specifically, the medicine introducing part 80 is arranged so that a base end portion thereof is directed toward the side of the medicine preparing part 30 and a tip end portion thereof can be inserted into the packaging bag P in the unsealed-state which is being in a forming process by the sealing device 50. Namely, the medicine introducing part 80 is inserted inside the two-folded packaging paper S at a position on the upper stream side of the carrying direction of the packaging paper S than the sealing device 50.

The detecting part 90 is used for detecting the presence of the medicines M in an introducing path for the medicines M due to the medicine introducing part 80. As shown in FIG. 6, the detecting part 90 includes a camera 92 which can photograph the introducing path for the medicines M due to the medicine introducing part 80 and an illuminating device 94. The camera 92 is arranged so as to photograph (detect) an inside of the packaging paper S on the upper stream side of the carrying direction of the packaging paper S than the sealing device 50. In this embodiment, the camera 92 is arranged so as to be directed from the base end side toward the tip end side of the medicine introducing part 80. Further, the medicine introducing part 80 is positioned on the upper stream side than the sealing device 50 as described above. Thus, the camera 92 is arranged so as to be capable of photographing (detecting) an area on the upper stream side of the carrying direction of the packaging paper S than the sealing device 50. Further, the illuminating device 94 includes a light source such as a light-emitting diode and a light bulb. The illuminating device 94 is arranged so as to be capable of illuminating an internal area of the medicine introducing part 80 from the base end side toward the tip end side of the medicine introducing part 80 as is the case with the camera 92.

Figure 8:
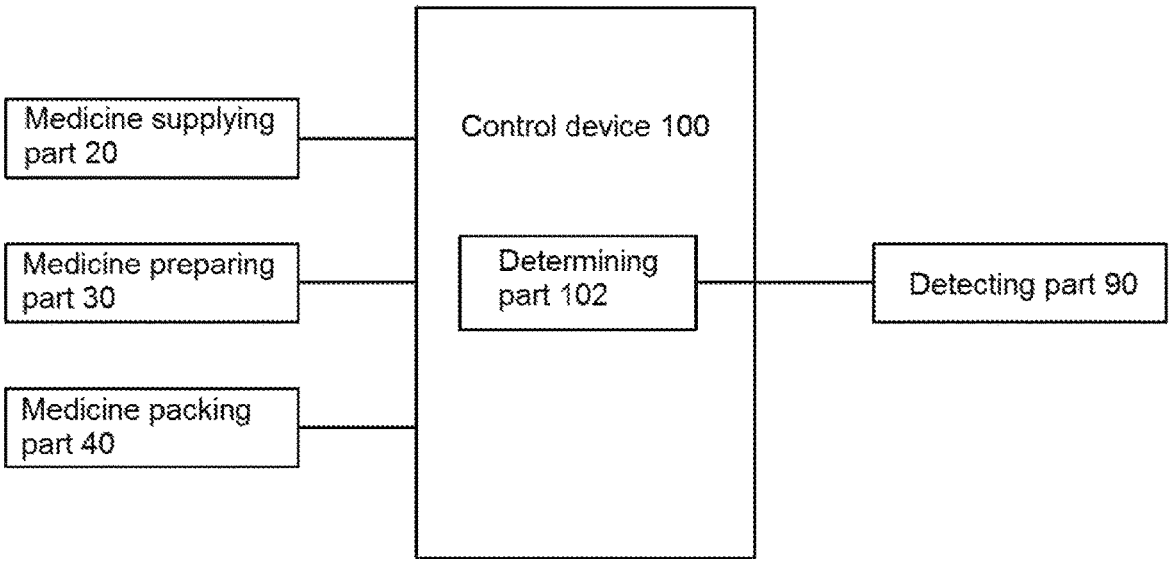
FIG. 8 is a block diagram formed so as to arrange a control device at a center in the medicine packaging apparatus shown in FIG. 1.

The control device 100 is used for controlling all of operations of the medicine packaging apparatus 10 and can be constituted of a digital circuit using a CPU or the like. As shown in FIG. 8, the medicine supplying part 20, the medicine preparing part 30 and the medicine packing part 40 are connected to the control device 100 so that operations of these parts can be controlled by the control device 100. Further, the detecting part 90 is connected to the control device 100 and a determining part 102 is provided in the control device 100. As described later, the control device 100 is enabled to use the determining part 102 to determine occurrence of the packaging failure caused by the event that the medicines M overflow from the packaging bag P in which the medicines M should be packaged based on a detection data inputted from the detecting part 90.

<<About a Forming Method for the Packaging Bag P and a Determining Method for the Packaging Failure>>

Subsequently, description will be given to a forming method for the packaging bag P by the sealing device 50 performed in the medicine packaging apparatus 10 and a determining method for the packaging failure performed in the forming process for the packaging bag P. In this regard, in the following description, the forming method for the packaging bag P is first outlined based on FIG. 10, and then a subroutine regarding a forming process for the second vertical seal is described based on FIG. 11.

[About the Forming Method for the Packaging Bag P]

Figure 10:
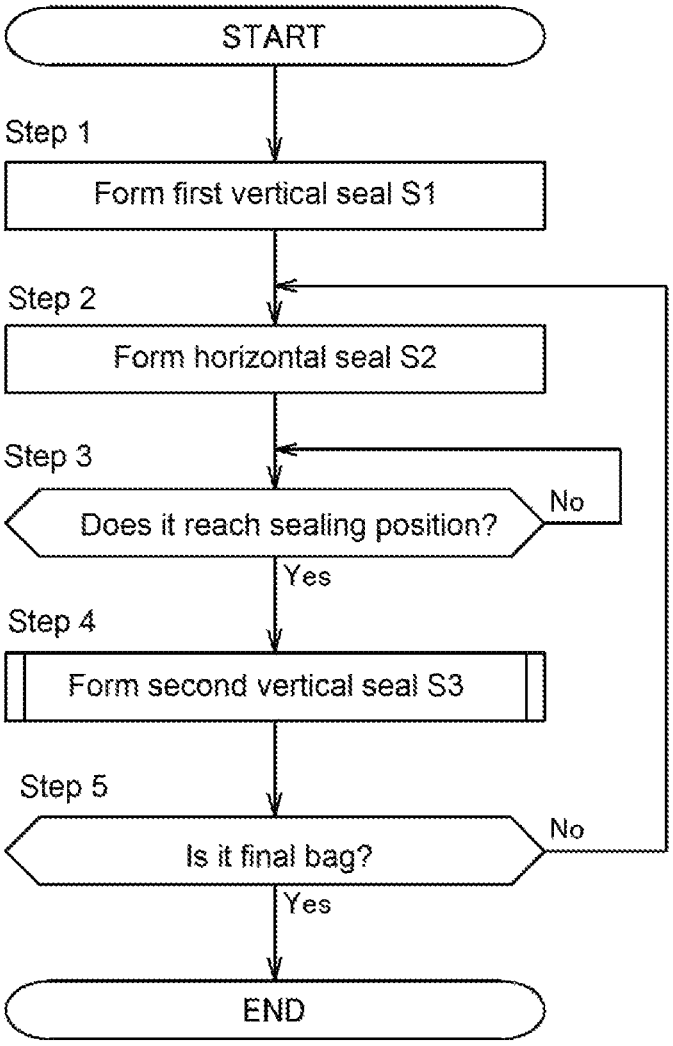
FIG. 10 is a flowchart according to a forming method of a packaging bag in the medicine packaging apparatus shown in FIG. 1.

The control device 100 forms the packaging bag P according to a control flow shown in FIG. 10. Hereinafter, concrete operations and controls are described according to FIG. 10.

(Step 1)

At the time of forming the packaging bag P, at a step 1, the vertical seal (hereinafter, sometimes referred to as "the first vertical seal S1") for closing an downstream end of the packaging bag P is first formed at a head position of the carrying direction of the packaging paper S by the vertically sealing members 56, 56 (see FIG. 5). After that, the control flow is shifted to a step 2.

(Step 2)

At the step 2, the horizontal seal S2 (see FIG. 5) for closing an end portion opposed to a folding line of the packaging paper S supplied in the two-folded state is formed. Specifically, by rotating the horizontally sealing members 58, 58 and passing the packaging paper S between the horizontally sealing members 58, 58, the horizontal seal is formed.

(Step 3)

At a step 3, it is confirmed whether or not the horizontal seal S2 is formed so as to reach a position (a sealing position) at which the packaging bag P should be sealed. In the case of determining that the horizontal seal S2 reaches the sealing position (the step 3=YES), the control flow is shifted to a step 4. In the case of determining that the horizontal seal S2 does not reach the sealing position (the step 3=NO), the control flow is returned to the step 2.

(Step 4)

Figure 11:
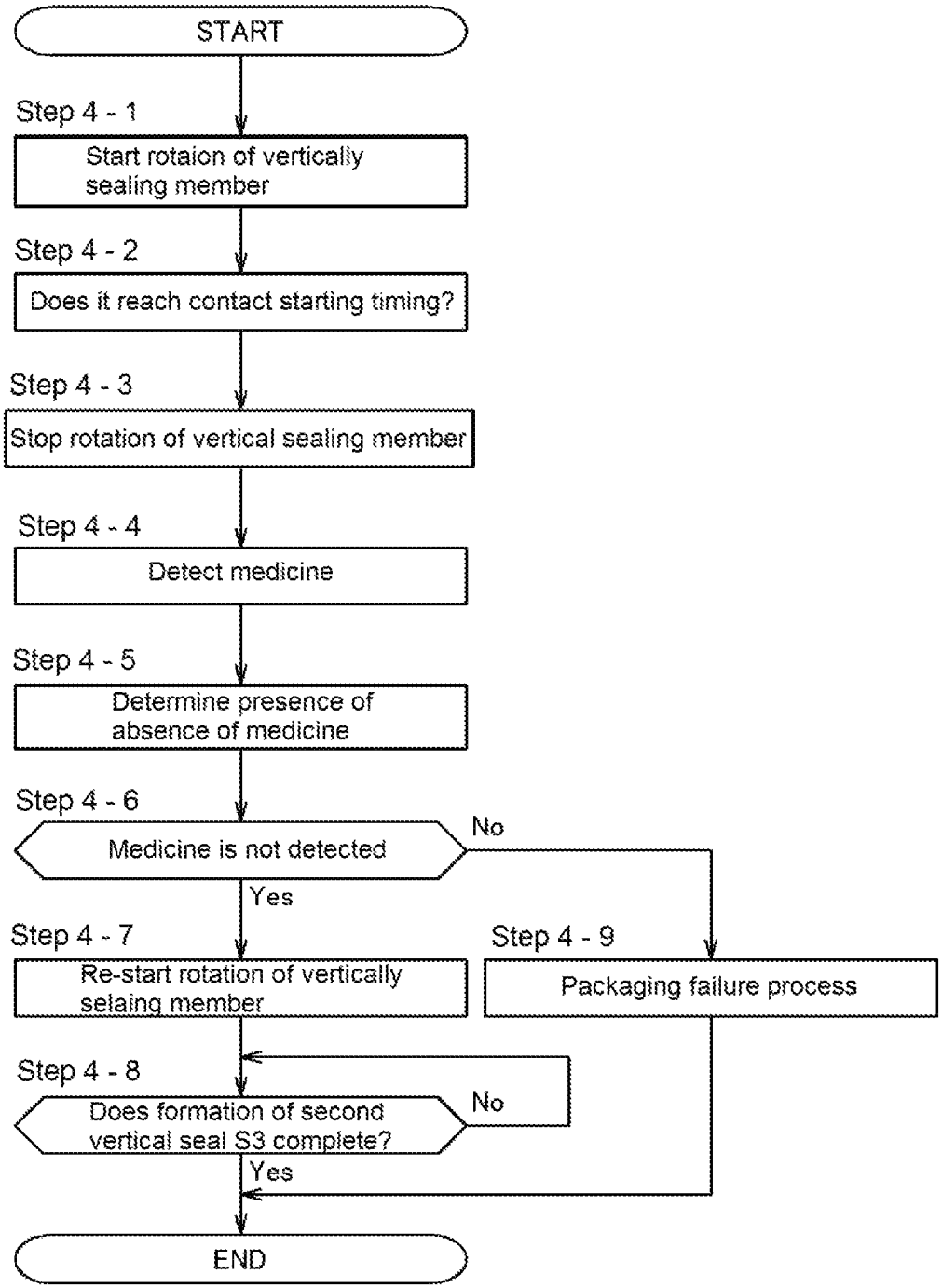
FIG. 11 is a flowchart showing a subroutine according to a forming process of a second vertical seal shown in FIG. 10.

At the step 4, the vertical seal (hereinafter, sometimes referred to as "the second vertical seal S3") for closing an end portion of the packaging bag P on the upper stream side of the carrying direction of the packaging paper S is formed according to a subroutine in FIG. 11 described later. Here, the second vertical seal S3 also serves as the first vertical seal S1 of a subsequently-formed packaging bag P. Thus, the second vertical seal S3 serves as a seal forming a boundary line between the packaging bags P continuously formed in the lengthwise direction of the packaging paper S. Once the second vertical seal S3 is formed, the control flow is shifted to a step 5.

(Step 5)

At the step 5, it is confirmed whether or not the packaging bag P sealed with the second vertical seal S3 at the step 4 is a final one. In the case where the packaging bag P sealed at the step 4 is not the final one (the step 5=NO), the control flow is returned to the step 2. In the case where the packaging bag P sealed at the step 4 is the final one (the step 5=YES), the series of the control flow completes.

(About the Forming Process for the Second Vertical Seal S3)

Subsequently, the subroutine of the forming process for the second vertical seal S3 regarding the described step 4 is described in detail with reference to FIG. 11.

(Step 4-1)

At a step 4-1, in order to form the second vertical seal S3, the rotation of the vertically sealing members 56, 56 is started so as to set the heating portions 64, 64 in a positional relationship that the heating portions 64, 64 face each other. After that, the control flow is shifted to a step 4-2.

(Step 4-2)

At the step 4-2, it is confirmed whether or not the process reaches a time point (a contact starting timing) when the heating portions 64, 64 of the vertically sealing members 56, 56 start to contact the packaging paper S as shown in FIG. 6. Here, it is possible to confirm whether or not the process reaches the contact starting timing with a variety of methods. Specifically, it may be possible to take a method of providing a timer for starting to count time from a timing of starting the rotation of the vertically sealing members 56, 56 at the step 4-1 and confirming that a predetermined time passes with this timer, a method of providing a rotation detecting device which can detect a rotational amount of the vertically sealing members 56, 56 and confirming whether or not the rotational amount reaches a predetermined amount, and a method of providing a detecting device which can detect an angle or a posture of the vertically sealing members 56, 56 and confirming whether or not the heating portions 64, 64 of the vertically sealing members 56, 56 are set in an angle or a posture for starting to contact, for example. In the case of confirming that the process reaches the contact starting timing (the step 4-2=YES) with any one of these methods, the control flow is shifted to a step 4-3. In the case of not confirming that the process reaches the contact starting timing (the step 4-2=NO) with the method, the control flow is kept at the step 4-2.

(Step 4-3)

At the step 4-3, a control for temporarily stopping the rotation of the vertically sealing members 56, 56 is performed. With this control, the vertically sealing members 56, 56 are set in a state that the vertically sealing members 56, 56 are temporarily stopped at a posture in which the heating portions 64, start to contact. After that, the control flow is shifted to a step 4-4.

(Step 4-4)

Figure 9A:
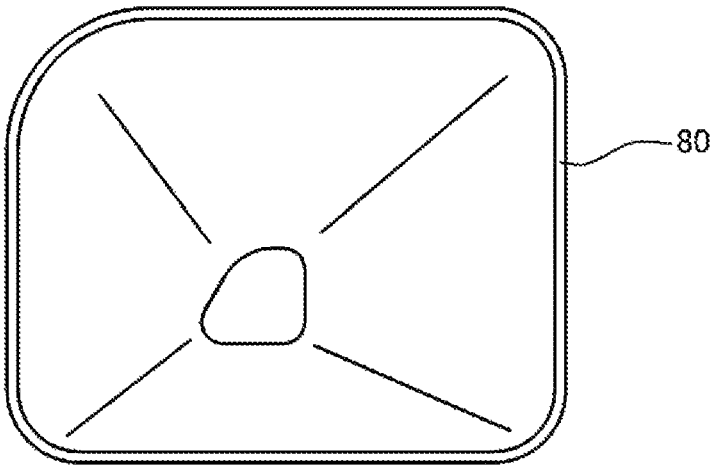
FIG. 9A is an explanation view showing one example of a detecting image obtained by the detecting part in a state that the medicines do not exist and FIG. 9B is an explanation view showing one example of a detecting image obtained in a state that the medicines exist.
Figure 9B:
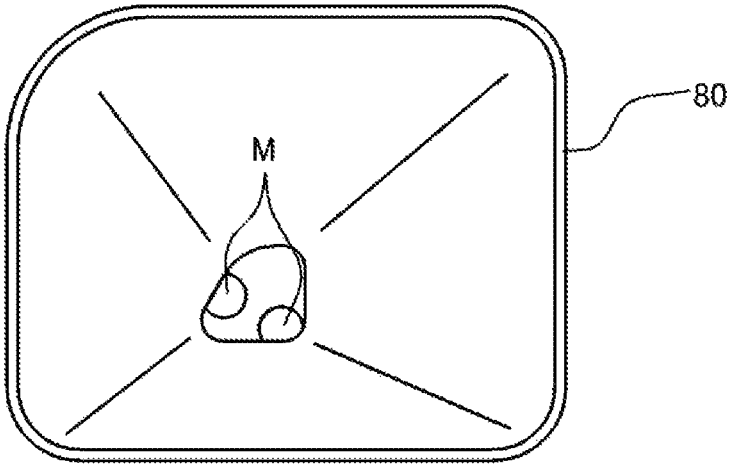

At the step 4-4, the presence or absence of the medicines M in the internal area of the medicine introducing part 80 and in an area inside the packaging paper S and on the upper stream side of the carrying direction than the vertical seal (the first vertical seal S1 or the second vertical seal S3) which has been already formed by the sealing device 50 is detected by the detecting part 90 (a sealing detection). At this time, the illuminating device 94 is turned on to illuminate the internal area of the medicine introducing part 80. The detection data obtained by the detecting part 90 is inputted into the control device 100. Although the detection data may be any data as long as it is useful for determining the presence or absence of the medicines M, image data photographed by the camera 92 is inputted into the control device 100 as the detection data in this embodiment. Specifically, in the case where the medicines M do not exist, an image only containing the medicine introducing part 80 is obtained as shown in FIG. 9A. In the case where the medicines M exist, an image containing the medicines M is obtained as shown in FIG. 9B. Such image data is inputted into the control device 100 as the detection data. After that, the control flow is shifted to a step 4-5.

(Step 4-5)

At the step 4-5, the determination for the presence or absence of the medicines M is performed by the determining part 102 of the control device 100 based on the detection data (the image data) obtained from the sealing detection performed at the step 4-4. In this embodiment, since the image data is obtained as the detection data, the determination for the presence or absence of the medicines M is performed with a method utilizing the image data such as an image analysis. Although the determination for the presence or absence of the medicines M may be performed with any method, it may be possible to preliminarily prepare an image obtained by the camera 92 in the case where the medicines M do not exist as a master image and perform the determination for the presence or absence of the medicines M with using the image actually obtained by the camera 92 and the master image, for example. In this regard, in the case where the determination is performed with using the master image as described above and the packaging paper S is contained in the image obtained by the camera 92, it is preferable to preliminarily prepare different master images depending on the kinds of the packaging paper S. Specifically, although the packaging paper S is supplied in a state that the packaging paper S is two-folded and two surfaces thereof are overlapped with each other, there are cases where the both surfaces of the packaging paper S are transparent, one of the surfaces of the packaging paper S is transparent and an un-transparent portion (for example, a belt having a color such as a white color) is provided on the other one of the surfaces, and the like. It is apparent that there are differences of images obtained by the camera 92 between the case of using the former packaging paper S and the case of using the latter packaging paper S having the un-transparent portion. Thus, in order to adapt the difference of the packaging paper S, it is preferable to preliminarily prepare the different master images depending on the kinds of the packaging paper S. After the determination for the medicines M is performed as described above, the control flow is shifted to a step 4-6.

(Step 4-6)

At step 4-6, it is confirmed whether or not the medicines M are detected as a result of the determination at the step 4-5. Here, in the case where the medicines M are not detected (the step 4-6=YES), it is estimated that the medicines M to be packaged are packed without overflowing from the packaging bag P. In this case, it is determined that the packaging of the medicines M is being performed normally and the control flow is shifted to a step 4-7. On the other hand, in the case where the medicines M are detected (the step 4-6=NO), there is a high possibility that the medicines M to be packaged in a previous packaging bag P1 (the packaging bag P on the lower side in FIG. 6) overflow from the packaging paper P as shown in FIG. 6 and the overflowing medicines M move to a packaging bag P2 (the packaging bag P being formed on the upper side in FIG. 6) to be subsequently formed. In this case, it is determined that the packaging failure occurs and the control flow is shifted to a step 4-9.

(Step 4-7)

At the step 4-7, a control for re-starting the rotation of the vertically sealing members 56, 56 which have been temporarily stopped at the step 4-3 is performed. With this control, the heating portions 64, of the vertically sealing members 56, 56 start to contact by surfaces and the second vertical seal S3 is formed.

(Step 4-8)

At a step 4-8, it is confirmed whether or not the forming of the second vertical seal S3 completes. In the case of determining that the forming of the second vertical seal S3 completes (the step 4-8=YES), the series of the control flow completes. On the other hand, in the case of determining that the forming of the second vertical seal S3 does not complete (the step 4-8=NO), the control at the step 4-8 is continuously performed.

(Step 4-9)

At a step 4-9, a process (a packaging failure process) for dealing with the event that the overflow of the medicines M is determined at the described step 4-6 is performed. Specifically, a process for informing that the packaging failure occurs by outputting an audio, displaying an image, lighting a lamp or the like is performed as the packaging failure process. With this process, the series of the control flow shown in FIG. 11 completes.

As described above, in the medicine packaging apparatus 10 of this embodiment, it is determined that the packaging failure occurs under the condition that the presence of the medicines M is detected by the detecting part 90 within the time period after the timing of starting to seal the packaging bag P in which the medicines M have been introduced and before the timing of introducing the medicines M to be packaged in the subsequent packaging bag P. With this process, it is possible to accurately detect the packaging failure caused by the event that the medicines M overflow from the packaging bag P in which the medicines M should be packaged, and thereby suppressing time and effort required for the inspection to the minimum.

Further, the described medicine packaging apparatus 10 is configured so that the timing when the vertically sealing members 56 contact the packaging paper S in order to form the second vertical seal S3 is set as the timing of staring to seal the packaging bag P in which the medicines M have been introduced, and at this timing, the bonding of the packaging paper P by the sealing device 50 is interrupted and the medicines M are detected by the detecting part 90. With this configuration, it is possible to detect the packaging failure caused by the event that the medicines M overflow at the time of sealing the packaging bag P with more higher detection accuracy. Further, it is possible to suppress failure such as the event that the medicines M overflowing from the packaging bag P are caught between the vertically sealing members 56, 56.

In this regard, although the example of detecting the medicines M by the detecting part 90 with considering the timing when the vertically sealing members 56 contact the packaging paper S in order to form the second vertical seal S3 as the timing of starting to seal the packaging bag P is described in this embodiment, the present invention is not limited thereto. It may be possible to perform the same process with considering another timing as the timing of starting to seal the packaging bag P. Further, although the example of detecting the medicines M by the detecting part 90 at the timing of starting to seal the packaging bag P is described in this embodiment, the present invention is not limited thereto. It may be possible to detect the presence of the medicines M at any timing (for example, after the sealing) within a time period after the timing of starting to seal the packaging bag P and before the sealing completes. Further, although the example of temporarily stopping the sealing by the vertically sealing members 56 at the timing of detecting the medicines M by the detecting part 90 is described in this embodiment, the present invention is not limited thereto. Specifically, it may be possible to configure so as not to stop the sealing by the vertically sealing members 56 at the time of detecting the presence or absence of the medicines M by the detecting part 90 or decrease a seal forming speed of the vertically sealing members 56.

In this regard, although the example in which the vertically sealing members 56, 56 and the horizontally sealing members 58, 58 which have the roller-shape can be individually controlled and driven in order to adapt the packaging bags P having different lengths is described as the sealing device 50 in this embodiment, the present invention is not limited thereto. Namely, in the case where the bag length of the packaging bag P is just required to be constant, it may be possible to configure the sealing device 50 so as to synchronously drive the vertically sealing members 56, 56 and the horizontally sealing members 58, 58.

Although the example of gripping and sealing the packaging paper S with the vertically sealing members 56, 56 and the horizontally sealing members 58, which have the roller-shape to form the packaging bag P is described in this embodiment, the present invention is not limited thereto. It may be possible to seal the packaging paper S with other aspects and methods to form the packaging bag P.

Further, although the example of sealing the portions of the packaging paper S overlapped with each other by two-folding the packaging paper S to form the packaging paper P is described in this embodiment, the present invention is not limited thereto. Specifically, it may be possible to supply two packaging papers S and bond the packaging papers S so as to overlap with each other to form the packaging bag P.

Although the example in which the detecting device including the camera 92 is described as the detecting device for detecting the medicines in the detecting part 90 in this embodiment, the present invention is not limited thereto. The detecting device may be any device as long as it can detect the presence of the medicines M. Specifically, it may be possible to provide an optical sensor, an infrared sensor and the like which can detect the presence or absence of the medicines M inside the packaging paper S and on the upper stream side of the carrying direction of the packaging paper S than the sealing device 50 as the detecting part 90. In this regard, in the case of using the optical sensor or the like as the detecting part 90, it is preferable to take measures for providing sufficient detection accuracy with considering characteristics of these sensors. Specifically, in the case of setting a detection distance of the optical sensor or the like to be short, there is a concern that the detection accuracy for the presence of small medicines M reduces. Namely, in the case where the size of the medicines M is small, a distance from the optical sensor or the like to the surface of each of the medicines M becomes larger than the case where the size of the medicines M is large. Thus, in the case of setting the detection distance of the optical sensor or the like to be short, there is a concern that the detection accuracy for the small medicines M reduces. On the other hand, in the case of setting the detection distance of the optical sensor or the like to be long, there is a concern that the vertically sealing members 56 or the like are detected as the medicines M. Thus, in the case of using the optical sensor or the like as the detecting part 90, it is preferable to take the measurements such as to set the detection distance with considering the size of the medicines M to be handled and the like.

Further, the detecting part 90 may be arranged at any position as long as it can detect the presence of the medicines M inside the packaging paper S and on the upper stream side of the carrying direction of the packaging paper S than the sealing device 50. Specifically, as shown with the dashed-two dotted line in FIG. 7, it may be possible to take a configuration in which the same detecting part 90*x* as the detecting part 90 is arranged at a position on the tip end side of the medicine introducing part 80 or a configuration in which a detecting part 90*y* is arranged on the upper stream side than the medicine introducing part 80.

Further, in order to improve the detection accuracy for detecting the event that the medicines M are accurately packaged, it may be possible to provide other sensors or the like in addition to the detecting part 90. Specifically, it may be possible to provide a falling sensor for detecting falling of the medicines M at the medicine introducing part 80 or the like. By setting an event that the medicines M are detected by the falling sensor and the overflow of the medicines M is not detected based on the detecting result by the detecting part 90 as a determination condition, it is possible to even more accurately detect whether or not the medicines M dispensed to be packaged are accurately packaged.

Although the example of utilizing the detecting part 90 in order to detect that the medicines M are accurately packaged at the time of sealing the packaging bag P is described in this embodiment, the detecting part 90 may be utilized for other purposes. Specifically, it may be possible to detect the presence of the medicines M with the detecting part 90 at the time when the medicines M to be packaged should be introduced from the medicine introducing part 80 into the packaging paper S. Namely, the detecting part 90 may be utilized for not only the described sealing detection but also the introducing detection for detecting the introducing of the medicines M into the packaging paper S by the medicine introducing part 80. In the case of doing in this way, it is also possible to effectively utilize the detecting part 90 for confirming whether or not the medicines M are supplied into the packaging paper S. Thus, it is possible to confirm the event that the overflow of the medicines M does not occur at the time of sealing the packaging paper S (the time of forming the packaging bag P) from the described sealing detection and also confirm the event that the medicines M are reliably supplied from the introducing detection. Further, it is possible to even more improve the detection accuracy for the event that the medicines M are accurately packaged by determining that the medicines are normally packaged only in the case of confirming the above both events.

Although the example of detecting the presence or absence of the medicines M by the detecting part 90 at the timing of starting to form the second vertical seal S3 is described in this embodiment, the present invention is not limited thereto. Namely, it may be possible to detect the medicines M by the detecting part 90 at any timing as long as the timing is within a time period (hereinafter, sometimes referred to as "detectable time period") after the timing of starting to seal the packaging bag P in which the medicines M have been introduced and before the timing of introducing the medicines to be packaged into the packaging bag P subsequently formed through the medicine introducing part 80. Specifically, the detection of the medicines M by the detecting part 90 may be performed within a time period after the sealing of the packaging bag P in which the medicines M have been introduced completes (after forming the second vertical seal S3) and before the timing of introducing the medicines to be packaged into the packaging bag P subsequently formed. Further, the detection by the detecting part 90 may be not only the detection at the predetermined timing (time point) within the described detectable time period but also a detection for keeping detecting over a predetermined time period within the detectable time period and a detection for intermittently detecting within the detectable time period.

Although the example in which the sealing device 50 can grip the packaging paper S with the roller-shaped members containing the vertically sealing members 56, 56 and the horizontally sealing members 58, 58 to bond the packaging paper S is described in this embodiment, the present invention is not limited thereto. It is possible to use a device which can bond the packaging paper S with another method instead of the sealing device 50. Specifically, it may be possible to use a device in which a pair of plate-like heating bodies each having a planar shape such as a T shape are provided and which can bond the packaging paper S by gripping the packaging paper S between the heating bodies instead of the sealing device 50 of this embodiment.

Although the example of continuously performing the detection for the presence or absence of the medicines M by the detecting part 90 and the determination performed by the determining part 102 based on this detection data in the described medicine packaging apparatus 10 is described, it may be possible to perform only the detection by the detecting part 90. In this case, it may be possible to take a configuration in which all of the detection data obtained from the detecting part 90 are later determined by the determining part 102 altogether or a configuration in which a user determines based on the detection data. In the case of providing the camera 92 at the detecting part 90 as is the above embodiment, it may be possible to take a configuration in which the photographing of the inside of the packaging paper S is performed for every package and then all of the photographed images obtained from the camera 92 are processed by the determining part 102 altogether to perform the determination or a configuration in which the user determines based on the photographed images.

Although the representative embodiment of the present invention is described up to here, the embodiment can be modified in various aspects within the range of the technical subject matter of the present invention described in the claims and all of these modifications are also contained in the present invention.

The present invention can be appropriately applied to a general medicine packaging apparatus for packaging medicines with a packaging paper.

What is claimed is:

1. A medicine packaging apparatus, comprising:

a packaging paper supplying part for supplying a packaging paper for packaging medicines;

a sealing part for sealing the packaging paper supplied from the packaging paper supplying part in a short direction of the packaging paper;

a medicine introducing part for introducing the medicines into the packaging paper on an upper stream side of a carrying direction of the packaging paper than the sealing part; and a detecting part for detecting presence of the medicines which are inside the packaging paper and on the upper stream side of the carrying direction than the sealing part;

wherein after the packaging paper is sealed, the detecting part can detect whether or not the medicines are present in a part of the packing paper at a head position of the carrying direction where the medicines are introduced before the medicines are introduced.

2. The medicine packaging apparatus according to claim 1, wherein the sealing part is used to form a half-bag shaped packaging paper in which a portion of the packaging paper on a downstream side of a travelling direction of the packaging paper which is used for forming the packaging bag is closed by a first vertical seal in a short direction of the packaging paper, form a horizontal seal extending in a lengthwise direction at the opening portion of the half-bag shaped packaging paper, form a second vertical seal and close the packaging paper in the short direction thereof.

3. A medicine packaging apparatus, comprising:

a packaging paper supplying part for supplying a packaging paper for packaging medicines;

a sealing part for forming a packaging bag from the packaging paper supplied from the packaging paper supplying part;

a medicine introducing part for introducing the medicines into a half-bag shaped packaging paper on an upper stream side of a carrying direction of the packaging paper than the sealing part, a detecting part for detecting presence of the medicines which are inside the packaging paper and on the upper stream side of the carrying direction than the sealing part; and a determining part for determining a packaging condition, wherein the sealing part is used to form the half-bag shaped packaging paper in which a portion of the packaging paper on a downstream side of a travelling direction of the packaging paper which is used for forming the packaging bag is closed by a first vertical seal in a short direction of the packaging paper, form a horizontal seal extending in a lengthwise direction at the opening portion of the half-bag shaped packaging paper, form a second vertical seal and close the packaging paper in the short direction thereof;

wherein the medicine packaging apparatus uses the detecting part to perform a sealing detection for detecting the presence of the medicines within a time period after a timing of starting to seal the half-bag shaped packaging paper in which the medicines have been introduced by the second vertical seal which is formed by the sealing part and before a timing of introducing the medicines should be packaged into a subsequent packaging bag through the medicine introducing part, and wherein an event that the presence of the medicines is not detected in the sealing detection, is set as a determination condition for determining that the medicines are normally packaged.

4. The medicine packaging apparatus according to claim 3, wherein the sealing detection is performed after a timing of starting to form a first vertical seal of the packaging bag formed subsequently to the packaging bag in which the medicines have been introduced.

5. The medicine packaging apparatus according to claim 3, wherein the sealing detection is performed after a timing of starting to form a horizontal seal of the packaging bag formed subsequently to the packaging bag in which the medicines have been introduced.

6. A medicine packaging apparatus, comprising:

a packaging paper supplying part for supplying a packaging paper for packaging medicines;

a sealing part for sealing the packaging paper supplied from the packaging paper supplying part in a short direction of the packaging paper;

a medicine introducing part for introducing the medicines into the packaging paper on an upper stream side of a carrying direction of the packaging paper than the sealing part; and a detecting part for detecting presence of the medicines which are inside the packaging paper and on the upper stream side of the carrying direction than the sealing part;

wherein after the packaging paper is sealed, a part of the packaging paper at a head position of the carrying direction where the medicines are introduced are photographed before the medicines are introduced into the part, and the detecting part can detect whether or not the medicines are present based on the photographed images.

7. The medicine packaging apparatus according to claim 6, wherein the sealing part is used to form a half-bag shaped packaging paper in which a portion of the packaging paper on a downstream side of a travelling direction of the packaging paper which is used for forming the packaging bag is closed by a first vertical seal in a short direction of the packaging paper, form a horizontal seal extending in a lengthwise direction at the opening portion of the half-bag shaped packaging paper, form a second vertical seal and close the packaging paper in the short direction thereof.

* * * * *